US012324942B2

(12) United States Patent
Phoeun et al.

(10) Patent No.: US 12,324,942 B2
(45) Date of Patent: Jun. 10, 2025

(54) EXERCISE BAG SYSTEM WITH MULTI-LOCKING CLOSURE SYSTEM

(71) Applicant: GORUCK Holdings, LLC, Jacksonville Beach, FL (US)

(72) Inventors: Suphun Phoeun, Jacksonville Beach, FL (US); Jason Jerome McCarthy, Jacksonville Beach, FL (US)

(73) Assignee: Goruck Holdings, LLC, Jacksonville Beach, FL (US)

( * ) Notice: Subject to any disclaimer, the term of this patent is extended or adjusted under 35 U.S.C. 154(b) by 95 days.

(21) Appl. No.: 18/126,176

(22) Filed: Mar. 24, 2023

(65) Prior Publication Data

US 2023/0302320 A1 Sep. 28, 2023

Related U.S. Application Data

(60) Provisional application No. 63/324,016, filed on Mar. 25, 2022.

(51) Int. Cl.
*A63B 21/06* (2006.01)
*A63B 21/00* (2006.01)

(52) U.S. Cl.
CPC ..... *A63B 21/0603* (2013.01); *A63B 21/4035* (2015.10); *A63B 2209/10* (2013.01)

(58) Field of Classification Search
CPC ..... A63B 21/06–0607
See application file for complete search history.

(56) References Cited

U.S. PATENT DOCUMENTS

D266,971 S 11/1982 Katz et al.
4,420,103 A 12/1983 Douglass
4,988,097 A * 1/1991 Smith ..... A45F 3/20 224/148.2
5,361,955 A 11/1994 Gregory
D354,619 S 1/1995 Soukeras
(Continued)

FOREIGN PATENT DOCUMENTS

CA 2518127 A1 3/2007
CN 305665419 3/2020
(Continued)

OTHER PUBLICATIONS

GoRuck Ruck Plate Explained, https://www.youtube.com/watch?v=q5VNK6SPIns, first available Apr. 29, 2015, retrieved Nov. 9, 2022, 1 pp.

(Continued)

*Primary Examiner* — Nyca T Nguyen
(74) *Attorney, Agent, or Firm* — Offit Kurman; Gregory Grissett

(57) ABSTRACT

The present disclosure is directed to an exercise bag system for carrying a mass of sand or other granular particles that includes a bag article, a first closure system, a second closure system and a third closure system. The first closure system is at the top and proximate the opening and inside the bag article. The second closure system is at the top and located entirely on the outer surface of the first side panel. The third closure system is at the top and on a foldable panel coupled to the first side panel, such that when the first closure system and the second closure system are engaged, the third closure system is configured to be engaged to seal the bag article.

11 Claims, 11 Drawing Sheets

(56) References Cited

U.S. PATENT DOCUMENTS

| | | | | |
|---|---|---|---|---|
| 6,230,950 | B1 * | 5/2001 | Heetman | A45C 7/0077 224/901.2 |
| D450,448 | S | 11/2001 | Pierce et al. | |
| D604,049 | S | 11/2009 | Chu et al. | |
| 8,109,863 | B2 * | 2/2012 | Gilberti | A63B 21/065 473/438 |
| 8,276,351 | B1 * | 10/2012 | Henkin | A63B 21/0603 53/469 |
| D690,502 | S | 10/2013 | Bergquist | |
| D692,229 | S | 10/2013 | Archambeau | |
| D733,420 | S | 7/2015 | Archambeau | |
| 9,072,365 | B1 | 7/2015 | Maneii | |
| D828,016 | S | 9/2018 | Gillespie et al. | |
| D830,053 | S | 10/2018 | Dumas | |
| 10,343,009 | B2 * | 7/2019 | Peyton | A63B 21/072 |
| 10,463,138 | B1 | 11/2019 | Boutin et al. | |
| D873,565 | S | 1/2020 | Long | |
| 10,702,047 | B1 | 7/2020 | Younan | |
| D954,162 | S * | 6/2022 | Coughlan | D3/289 |
| 11,504,566 | B2 * | 11/2022 | Fujii | A63B 21/0603 |
| 11,931,639 | B2 * | 3/2024 | Coughlan | A63B 21/072 |
| 2010/0048363 | A1 * | 2/2010 | Gilberti | A63B 21/0603 482/105 |
| 2010/0176172 | A1 | 7/2010 | Gleason, Jr. | |
| 2010/0270317 | A1 * | 10/2010 | Kieling | B65D 81/3895 220/592.25 |
| 2011/0120893 | A1 | 5/2011 | Rekuc et al. | |
| 2012/0052161 | A1 * | 3/2012 | Woodham | B65D 31/10 383/203 |
| 2012/0058863 | A1 * | 3/2012 | Brizard | A63B 21/0603 482/93 |
| 2013/0221051 | A1 | 8/2013 | Hairston et al. | |
| 2015/0157115 | A1 | 6/2015 | Smith | |
| 2016/0235186 | A1 | 8/2016 | Chueh | |
| 2018/0352939 | A1 | 12/2018 | Buffinton | |
| 2019/0184252 | A1 * | 6/2019 | Raines | A63B 41/085 |
| 2019/0299046 | A1 * | 10/2019 | Tomellini | A63B 21/4035 |
| 2020/0215375 | A1 * | 7/2020 | Fujii | A63B 21/072 |
| 2021/0346777 | A1 * | 11/2021 | Coughlan | A63B 21/0603 |
| 2022/0125183 | A1 | 4/2022 | McCarthy et al. | |
| 2022/0304454 | A1 | 9/2022 | McCarthy et al. | |
| 2022/0354239 | A1 | 11/2022 | McCarthy et al. | |

FOREIGN PATENT DOCUMENTS

| | | | |
|---|---|---|---|
| CN | 307305405 | | 5/2022 |
| GB | 606926 | | 8/2019 |
| JP | 2004008765 | A | 1/2004 |
| KR | 200451347 | Y1 | 12/2010 |
| WO | 2022087417 | A1 | 4/2022 |
| WO | 2022236092 | A1 | 11/2022 |

OTHER PUBLICATIONS

GoRuck Products, https://www.goruck.com/products/ruck-plate-carrier, first available Oct. 23, 2020, retrieved Nov. 15, 2022, 8 pp.
GoRUck Murph, https://www.youtube.com/watch?v=J_x10-d7eLQ, first available May 8, 2020, retrieved Nov. 9, 2022, 2 pp.
GoRuck, The GoRuck Rucker 2.0 First Look & Preview, All Day Ruckoff, Feb. 23, 2018, 45 pp.
GoRuck Ruck Plate Carrier 2.0 Review, https://www.youtube.com/watch?v=AyR_nbVdg_k,.
Authorized Officer: Miki Kobayashi, International Preliminary Report on Patentability, International Patent Application PCT/US2021/056261, Report Issued Apr. 13, 2023, 9 pp.
Authorized Officer: Daniela Dinesco, International Search Report and the Written Opinion, International Patent Application PCT/US2021/056261, Report Completed Feb. 2, 2022, 11 pp.
Authorized Officer: Manuel Henry, International Search Report and the Written Opinion, International Patent Application PCT/US2022/028129, Completed Aug. 9, 2022, 13 pp.

* cited by examiner

EXERCISE BAG SYSTEM WITH MULTI-LOCKING CLOSURE SYSTEM

CROSS-REFERENCE TO RELATED APPLICATIONS

The present application claims priority to and the benefit of U.S. Provisional Patent Application No. 63/324,016, filed Mar. 25, 2022, the contents of which are hereby incorporated in its entirety.

TECHNICAL FIELD

The present disclosure relates generally to an exercise bag system with a multi-locking closure system.

BACKGROUND

Rucking is an exercise regimen that is used in military training protocols to build strength and endurance. A person carries a weighted bag while completing various activities, like running, push-ups, etc. Specially designed exercise articles can be worn like a backpack and also include a compartment for holding weighted plates, nicking plates, or sand. Typical weighted bags, such as sandbags used for exercise, have an outer bag, with handles and the like, and an inner or filter bag, which is designed to contain sand and/or other materials. The inner bags have closures for closing the bag once filled with sand. However, as a result, sand and debris will become embedded in the closure system, which can cause closure failure over time. It is to be understood that the weighted bags can be offered in a variety of weights based upon user preference and the predetermined parameters of an exercise threshold established by a user.

Stability during use is important because of a wide range of upper and lower body movements involved in traditional nicking training protocols. The weighted bags should carry weight but not necessarily inhibit a user's balance and agility across a wide range of body movements during use. Such a design allows a user to customize workout routines based on the desired regimen.

Conventional exercise bag systems often cause discomfort due to insufficient support, lack of padding, and abrasive fabrics that result in friction burns, constricted movement during exercise regimens, and injury.

SUMMARY

There is a need for an exercise bag system with an internal bag having a multi-locking closure system that provides a user with improved stability. There is also a need for systems, devices, and procedures to improve bag durability and sand or particle retention for weighted exercise bag systems. Accordingly, an embodiment of the present disclosure is an exercise bag system for carrying a mass of sand or other granular particles. The exercise bag system may include a bag article for carrying a mass of sand and the like and an outer bag article, with handles and the like for grip and use based on user preference.

An embodiment of the present disclosure includes an exercise bag system for carrying a mass of sand or other granular particles. The exercise bag system includes a bag article, a first closure system, a second closure system and a third closure system. The bag article includes a bottom, a top spaced from the bottom, an opening at the top, and at least first and second side panels that extend from the bottom to the top and define an internal space such that the opening provides access to the internal space, wherein each of the first and second side panels have an inner surface that at least partially defines the internal space, and outer surface. The first closure system is at the top and proximate the opening and inside the bag article. The second closure system is at the top and located entirely on the outer surface of the first side panel. The third closure system is at the top and on a foldable panel coupled to the first side panel, such that, only when the first closure system and the second closure systems are engaged, the third closure system is configured to be engaged to seal the bag article.

Another embodiment of the present disclosure includes an exercise bag system for carrying a mass of sand or other granular particles. The exercise bag system includes a bag article, a first closure system, a second closure system and a third closure system. The bag article includes a bottom, a top spaced from the bottom, an opening at the top, and at least first and second side panels that extend from the bottom to the top and defines an internal space such that the opening provides access to the internal space, wherein each of the first and second side panels have an inner surface that at least partially defines the internal space, and outer surface. The first closure system is at the top and proximate the opening and inside the bag article. The first closure system includes a first closure element on the inner surface of the first side panel and a second closure element on the inner surface of the second side panel opposite the first closure element, wherein the first closure element and second closure element are configured to be removably attached to each other. The second closure system is at the top and located entirely on the outer surface of the first side panel. The second closure system includes a first closure element at the top on the outer surface and opposite the first closure element of the first closure system on the inner surface. The second closure system further includes a second closure element on the outer surface that is adjacent to the first closure element on the outer surface, such that the first closure element and second closure element of the second closure system are configured to fold toward each other and be removably attached to each other. The third closure system is at the top and includes a second closure element on the outer surface of the second side panel opposite the second closure element of the first closure element. The third closure system further includes a first closure element located on a foldable panel coupled to the first side panel and adjacent the second closure element of the second closure system, such that, when the first closure system and second closure system are engaged, the second closure element of the third closure system is configured to be removably attached to the second closure element of the third closure system.

Another embodiment of the present disclosure includes an exercise bag system for carrying a mass of sand or other granular particles. The exercise bag system includes a bag article, a first closure system, a second closure system and a third closure system. The bag article includes a bottom, a top spaced from the bottom, an opening at the top, and at least first and second side panels that extend from the bottom to the top and define an internal space such that the opening provides access to the internal space, wherein each of the first and second side panels have an inner surface that at least partially defines the internal space, and outer surface. The first closure system is at the top and proximate the opening and inside the bag article. The first closure system includes a hook closure on the inner surface of the first side panel and a loop closure on the inner surface of the second side panel opposite the hook closure, wherein the hook closure and loop closure are configured to be removably attached to each other. The second closure system is at the top and located entirely on the outer surface of the first side panel. The second closure system includes a hook closure at the top on the outer surface and opposite the hook closure of the first closure system on the inner surface. The second closure system further includes a loop closure on the outer surface that is adjacent to the hook closure on the outer surface, such that the hook closure and loop closure of the second closure system are configured to fold toward each other and be removably attached to each other. The third closure system is at the top and includes a loop closure on the outer surface of the second side panel opposite the loop closure of the first closure system. The third closure system further includes a hook closure located on a foldable panel coupled to the first side panel and adjacent the loop closure of the second closure system, such that, when the first closure system and the second closure system are engaged, the hook closure of the third closure system is configured to be removably attached to the loop closure of the third closure system.

BRIEF DESCRIPTION OF THE DRAWINGS

The foregoing summary, as well as the following detailed description of exemplary embodiments of the present application, are better understood when read in conjunction with the appended drawings. For the purposes of illustrating the present application, there is shown in the drawings, exemplary embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1:
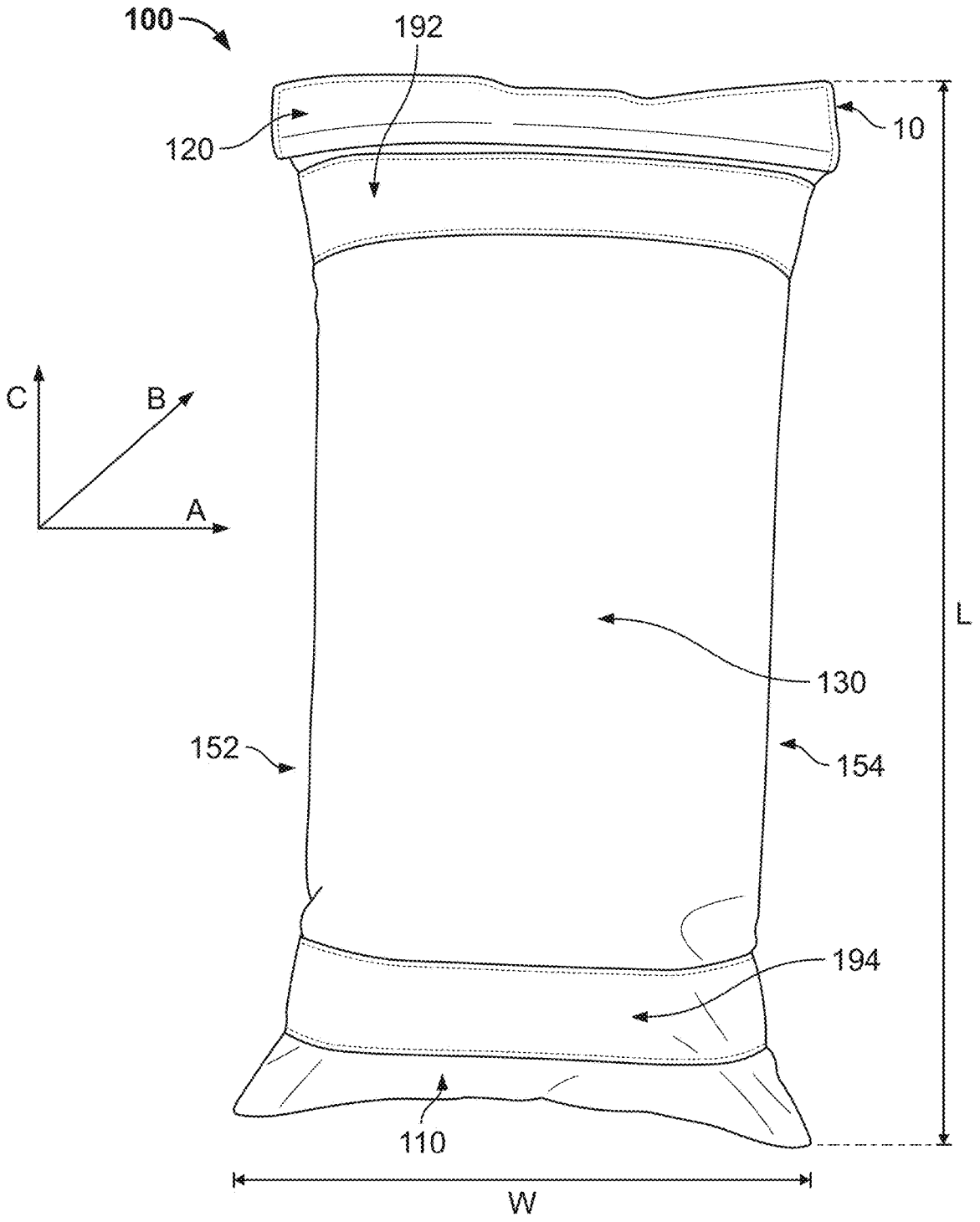
FIG. 1 is a front view of an exercise bag system in accordance with an embodiment of the present disclosure.

There is a need for systems, devices, and procedures to improve bag durability and sand or particle retention for weighted exercise bag systems. An embodiment of the present disclosure is an exercise bag system 10 for carrying a mass of sand or other granular particles while retaining the mass of sand or granular particles therein during use. The bag article 100 may be referred to as a rucking sack, rucker, or ruck sack, and is specifically configured to conformably hold a sand or other material, e.g., weighted material, of varying weight based on user preference. The bag article 100 is designed to be carried, lifted, etc., by a user during physical activity associated with a training regimen. The bag article 100 can be filled with weighted material and used as part of different exercise routines within a training regimen. The bag article 100 includes a combination of features that improve stability when carried by a user, namely when the user engages in strenuous physical activity that involves a variety of upper and lower body movements while lifting and throwing the bag article 100. Advantageously, the bag article 100 helps provide stability and versatility to the user by improving distributions of loads and allowing the user to incorporate the bag article into a variety of different exercise routines based on the desired training regimen or targeted muscle area.

As shown in FIGS. 1-11, the exercise bag system 10 may include a bag article 100 for carrying mass of sand and the like and an optional outer bag 20. The exercise bag system 10 may include a first closure system 160, a second closure system 170 and a third closure system 180. The three closure systems are in position on the bag article to ensure that sand and the like does not escape during exercise use, as further described below.

Referring now to FIGS. 1-11, the bag article 100 includes a bottom 110, a top 120 spaced from the bottom 110, an opening 124 at the top 120, and at least first and second side panels 130, 140 that extend lengthwise from the bottom 110 to the top 120. The first side panel 130 and the second side panel 140 define an internal space 150 such that the opening 124 provides access to said internal space 150. Specifically, each of the first and second side panels 130, 140 have an inner surface 132, 142 that at least partially defines the internal space 150. Each of the first and second side panels 130, 140 also have an outer surface 134, 144 opposite the inner surfaces 132, 142.

As shown in FIG. 1, the first side panel 130 and second side panel 140 are connected along the first side edge 152 and the second side edge 154, wherein the second side edge 154 is opposite the first side edge 152. Collectively, inner surfaces of the bottom 110, top 120, first side panel 130, and second side panel 140 define the internal space 150 that is sized to receive therein a mass of sand 30 or other granular particles. More specifically, the bag article 100 is configured so that the sand 30 (or other weighted material), when placed inside the bag article 100, occupies a substantial majority of the internal space 150.

The bottom 110 and top 120 are spaced apart along a length direction C (FIG. 1), outermost portions of the respective first side panel 130 and second side panel 140 are variably spaced apart along a depth direction B, and the side edges 152, 154 are spaced apart with respect to each other along a lateral (or width) direction A. Accordingly, the length direction C is substantially perpendicular to the depth direction B and lateral direction A. The orthogonal directions A, B, and C are used in the present disclosure only for illustrative purposes to aid in clarifying the relative positions of the components of the bag article 100. In particular it is to be understood that the depth direction B will vary based on the location where a measurement is taken along the respective first and second side panels 130, 140 when the internal space 150 is occupied by sand 30.

Figure 11:
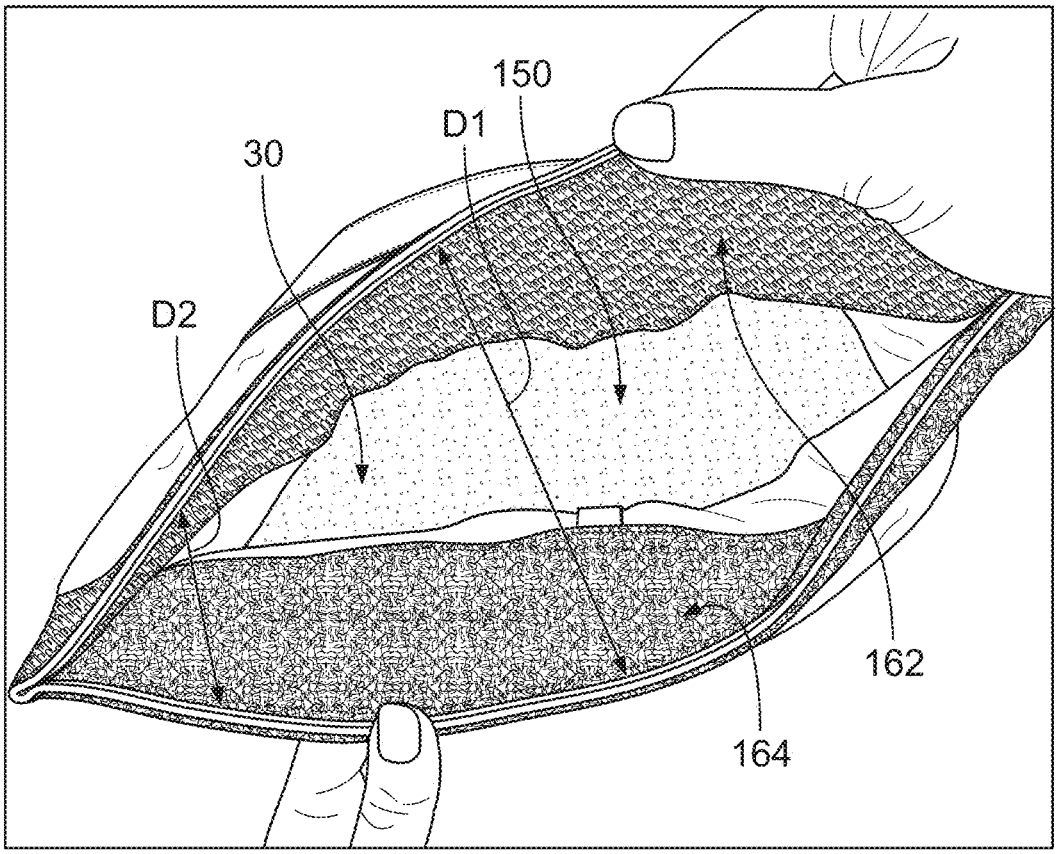
FIG. 11 is a top plan view of the exercise bag system shown in FIG. 1 in the open position and filled with sand.

As shown in FIG. 11, the distance between the first side panel 130 and the second side panel 140 is generally larger in the middle (D1) relative to the distance between the first side panel 130 and the second side panel 140 adjacent the side edges 152, 154 (D2). However, it is to be understood that when the internal space 150 of the bag article 100 is substantially empty, D1 and D2 will be substantially similar.

As shown in FIG. 1, the first side panel 130 and the second side panel 140 are coupled together at the first side edge 152 and the second side edge 154. It is to be understood that the first and second side panel 130, 140 are also coupled together at a bottom side edge (not shown) along the bottom 110. It is to be understood that the first side panel 130 and second side panel 140 may be of unitary construction. However, the first side edge 152, second side edge 154, and bottom side edge may optionally include additional stitching or durable woven fabrics using high tenacity yarns to prevent the bag article 100 from tearing at the sides after prolonged use of the bag article 100 by a user.

Referring now to FIGS. 4-8, the exercise bag system 10 includes the first closure system 160 at the top 120 and proximate the opening 124 and inside the bag article 100. The first closure system 160 includes a first closure element 162 (i.e., hook closure) on the inner surface 132 of the first side panel 130 and a second closure element 164 (i.e., loop closure) on the inner surface 142 of the second side panel 140 opposite the first closure element 162. The first and second closure elements 162, 164 are configured to be removably attached to each other.

Continuing with FIGS. 4-8, the exercise bag system 10 includes the second closure system 170 at the top 120 and located entirely on the outer surface 134 of the first side panel 130. The second closure system 170 includes a first closure element 172 (i.e., hook closure) at the top 120 on the outer surface 134 and opposite the first closure element 162 of the first closure system 160 on the inner surface 132. The second closure system 170 includes a second closure element 174 (i.e., loop closure) on the outer surface 134 that is adjacent to the first closure element 172 on the outer surface 134. As a result, the first and second closure elements 172, 174 of the second closure system 170 are configured to fold toward each other and be removably attached to each other.

Referring now to FIGS. 4-8, the exercise bag system 10 includes the third closure system 180 at the top 120. The third closure system 180 includes a second closure element 184 (i.e., loop closure) on the outer surface 144 of the second side panel 140 opposite the second closure element 164 of the first closure system 160. The third closure system 180 includes a first closure element 182 (i.e., hook closure) located on a foldable panel 155 coupled to the first side panel 130 and adjacent the second closure element 174 of the second closure system 170. In this manner, when the first closure system 160 and the second closure system 170 are engaged, the first closure element 182 of the third closure system 180 is configured to be removably attached to the second closure element 184 of the third closure system 180.

In use, once the internal space 150 is substantially filled with a desired amount of weighted material (e.g., sand), the first closure system 160 is closed. That is, the hook closure 162 and the loop closure 164 are engaged to close the first closure system 160. Thereafter, the user can engage the second closure system 170 by folding the top 120 over such that the hook closure 172 and the loop closure 174 are engaged to close the second closure system 170. Finally, the foldable panel 155 can then be folded upwardly so that the third closure system 180 is engaged. Specifically, the hook closure 182 and the loop closure 184 are engaged to close the third closure system 180. By utilizing the first closure system, second closure system and third closure system, leakage of weighted material such as sand is nearly eliminated, and sand does not leak into the various closure systems. This results in improved durability of the exercise bag system 10 such that it can be used for a longer period of time before replacement is required.

It is to be understood that the closure systems described above are intended such that certain hook and loop closures are used in specific locations. However, the hook closures and loop closures may be interchanged as needed, so long as the three closure systems can be removably coupled as shown and described in the present disclosure and FIGS. 1-11.

The bag article 100 and its components are preferably comprised of durable woven fabrics that may encase a cushion member, e.g., a foam, felt, batting or other composite material.

The bag article 100 includes a plurality of double pass stitch lines 190 that extend across an entirety of the second side panel 140, namely between the top 120 and the bottom 110 and between the first side edge 152 and the second side edge 154. In other words, the stitch lines 190 are located along the middle of the second side panel 140. In accordance with an aspect, the stitch lines 190 are an interlocking system of fabric and seams to ensure that the bag article 100 withstands tension and pressure from weighted material (e.g., sand) loaded in the internal space 150 during use of the bag article 100 by a user. The stitch lines 190 are configured to alleviate pressure points and reduce wear and tear along the first and second side edges 152, 154. When filled with weighted material, the bag article 100 is lifted, thrown, and pushed by a user as part of a desired training regimen. However, when the bag article 100 moves around, the pressure of the weighted material pushes outward. The stitch lines 190 allow the bag article 100 to be used for a longer period of time before replacement is required.

The bag article 100 includes a pair of webbing members, one disposed along a location adjacent to the bottom 110 and another disposed along a location adjacent to the top 120. Specifically, the bag article 100 includes an upper webbing 192 positioned adjacent the top 120 that extends across a width of the first and second side panels 130, 140. Similarly, the bag article 100 includes a lower webbing 194 positioned adjacent the bottom 110 that extends across a width of the first and second side panels 130, 140. Each of the upper and lower webbing 192, 194 have a width of approximately 2 inches and may include a plurality of encased layers that include one or more cushion elements (not shown). The cushion elements may comprise an open cell foam, closed cell foam or another compressible and resilient material suitable to provide support. In accordance with an aspect of the present disclosure, the upper and lower webbing 192, 194 are made of nylon. In general, the upper and lower webbing 192, 194 allow the bag article 100 to maintain a consistent load and shape when the internal space 150 is filled with a weighted material. Conventional sandbags often become unevenly distributed and can result in injuries to a user during training activities that involve the sandbag (e.g., bag article). In addition to maintaining the shape of the bag article 100, the upper and lower webbing 192, 194 helps reduce the pressure of the weighted material pushing outward during use. As a result, the bag article 100 may be used for a longer period of time before replacement is required.

The webbing 192, 194 is substantially rectangular and, as previously discussed, the webbing extends across the entirety of the width of the first and second side panels 130, 140. However, it is to be understood that the webbing may have other shapes and configurations suitable for their intended purpose of reducing tension on the edges of the bag article 100 and improving the shelf life of the bag article 100. In accordance with an embodiment, the webbing 192, 194 may also be of modular construction and formed from a plurality of webbing segments.

The bag article 100 is moveable between a first position and a second position for removably securing weighted material (i.e., sand) into the internal space 150. Specifically, each of the first, second, and third closure systems 160, 170, 180 are opened in a first position (FIG. 5) for loading the weighted material into the internal space 150, and closed in a second position (FIGS. 1 and 10) for securing the weighted material in the internal space 150.

As previously discussed, each of the first, second and third closure systems include a first closure element (i.e., hook closure) and a second closure element (i.e., loop closure) configured to selectively engage each other to gain access to the internal space 150 for loading and unloading the weighted material. Although the closure elements are described as hook and loop closures, it is to be understood that other fastener types may be used.

Referring now to FIG. 1, the internal space 150 of the bag article 100 is sized to conform to the weighted materials so that movement of the weighted materials in the bag article 100 during use is minimized. In particular, the internal space 150 is defined by inner surfaces of the bottom 110, top 120, first side panel 130, and second side panel 140. As a result, the bag article 100 has an overall width W that extends from the first side edge 152 to the second side edge 154. Similarly, the bag article 100 has an overall length L that extends from the bottom 110 to the top 120. The length L is perpendicular to the overall width W. In one exemplary embodiment of the bag article 100 configured to hold 40 LBS, the bag article 100 has an overall width W between 7 and 10 inches and an overall length L between 20 and 24 inches. However, it is to be understood that the overall width W and overall length L will vary based on the desired weighted material to be held. That is, the bag article 100 may be sized and shaped in a variety of dimensions to accommodate 40 LB, 60 LB, 80 LB, 100 LB, 120 LB, and 200 LB. It is to be understood that the dimensions will vary and increase as the amount of desired weighted material increases. For example, a bag article 100 configured to hold 200 LBS has an overall width W between 7 and 10 inches and an overall length L between 65 and 75 inches.

Figure 3:
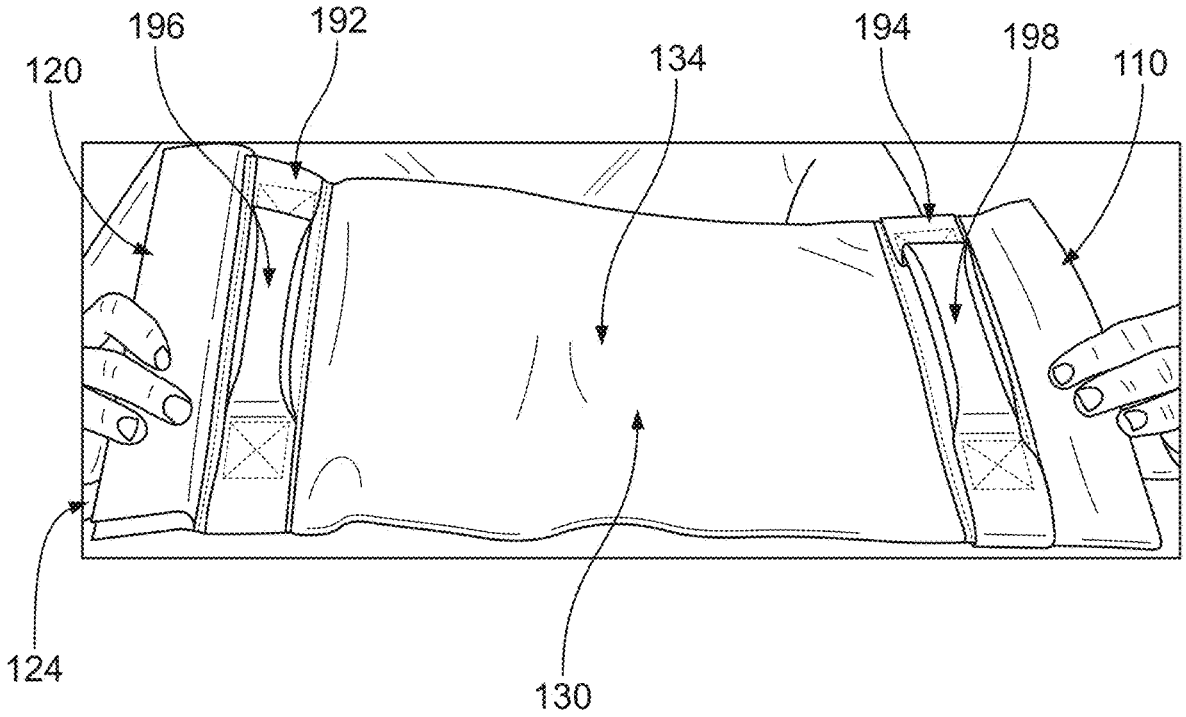
FIG. 3 is a front perspective view of the exercise bag system shown in FIG. 1.
Figure 4:
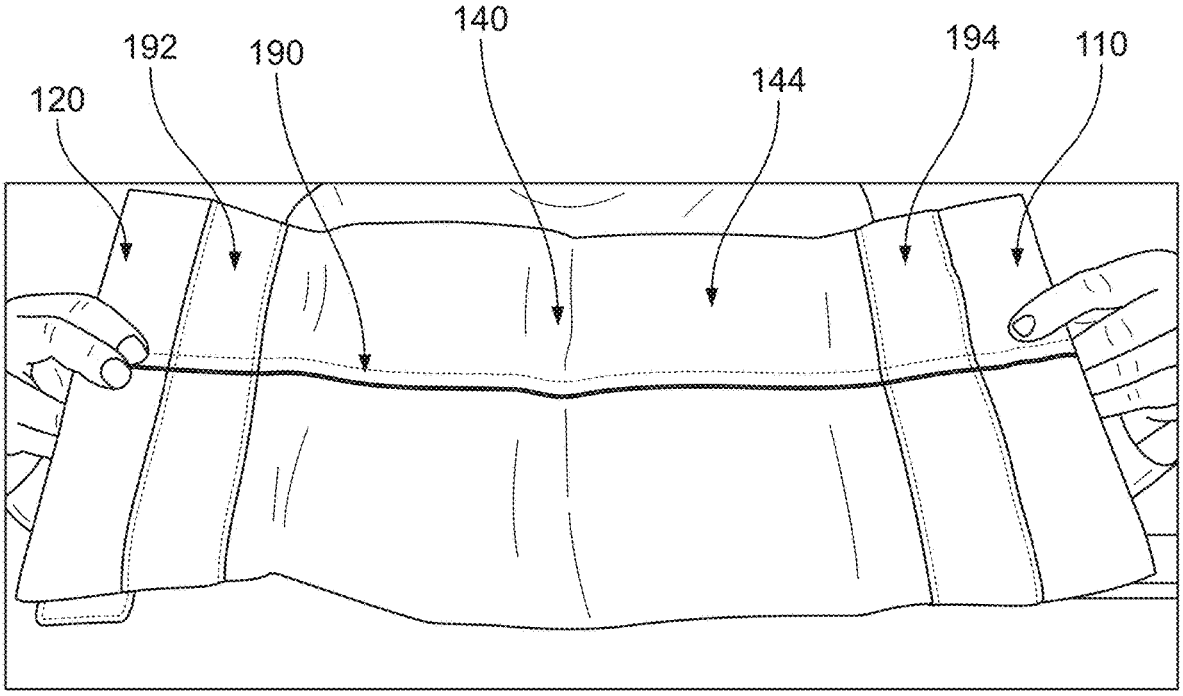
FIG. 4 is a rear perspective view of the exercise bag system shown in FIG. 1.
Figure 5:
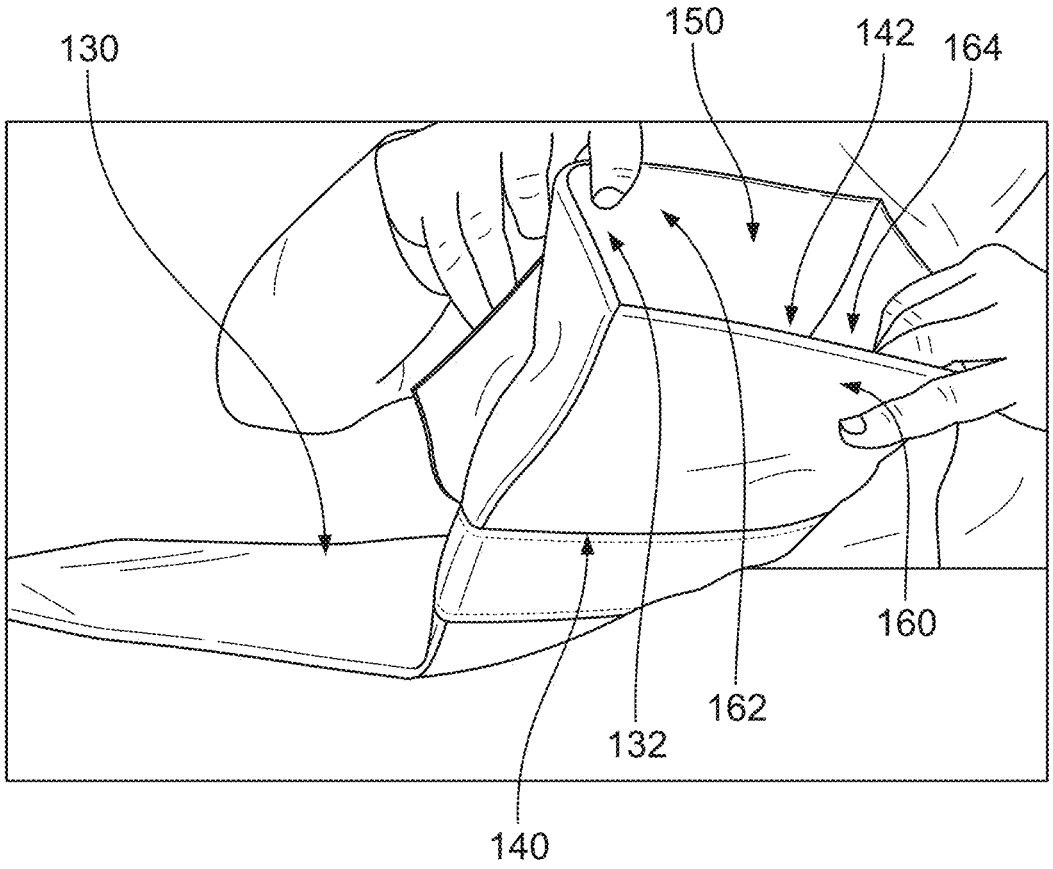
FIG. 5 is a perspective view of a first closure system of the exercise bag system shown in FIG. 1.
Figure 6:
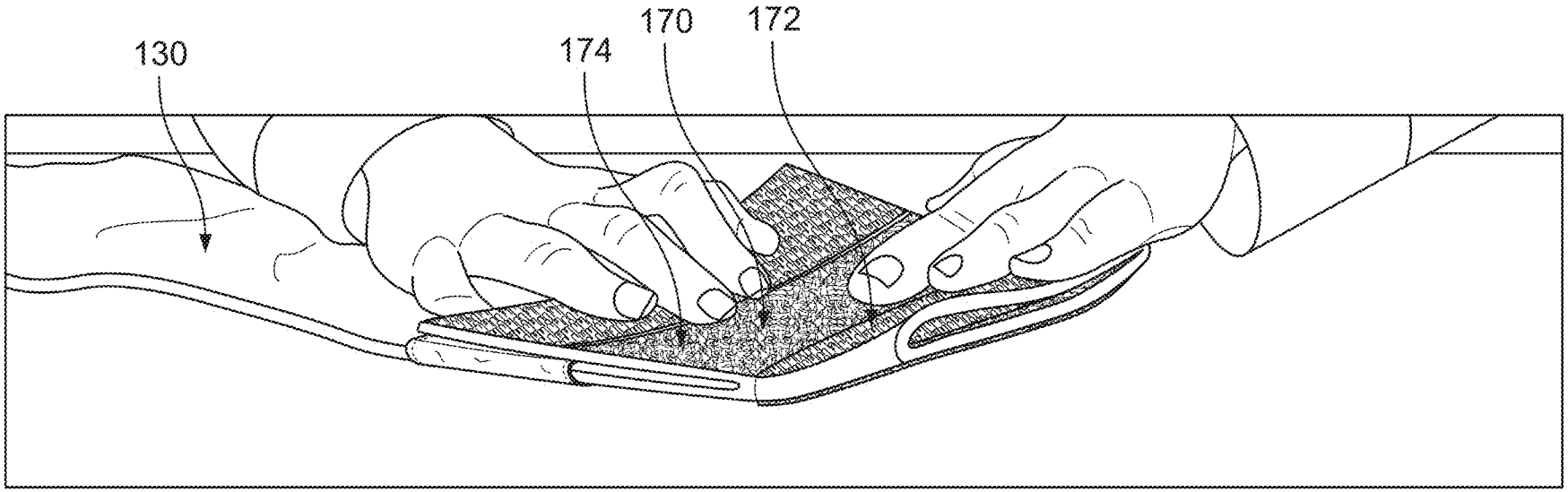
FIG. 6 is a perspective view of a second closure system of the exercise bag system shown in FIG. 1.
Figure 7:
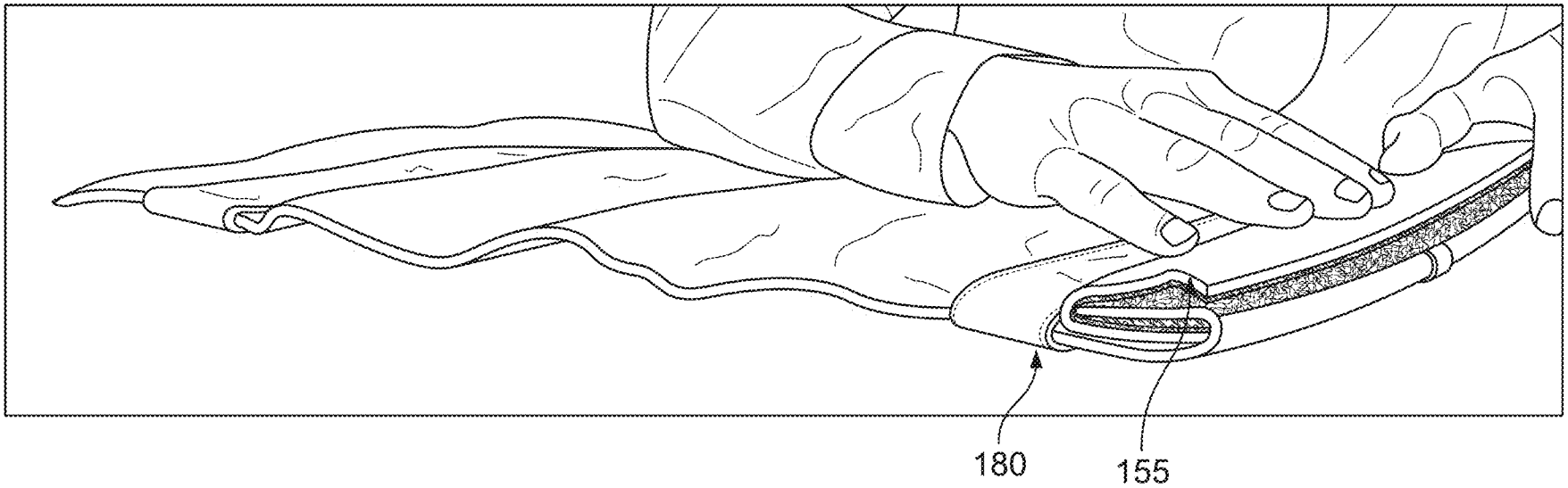
FIG. 7 is a perspective view of a third closure system of the exercise bag system shown in FIG. 1.
Figure 8:
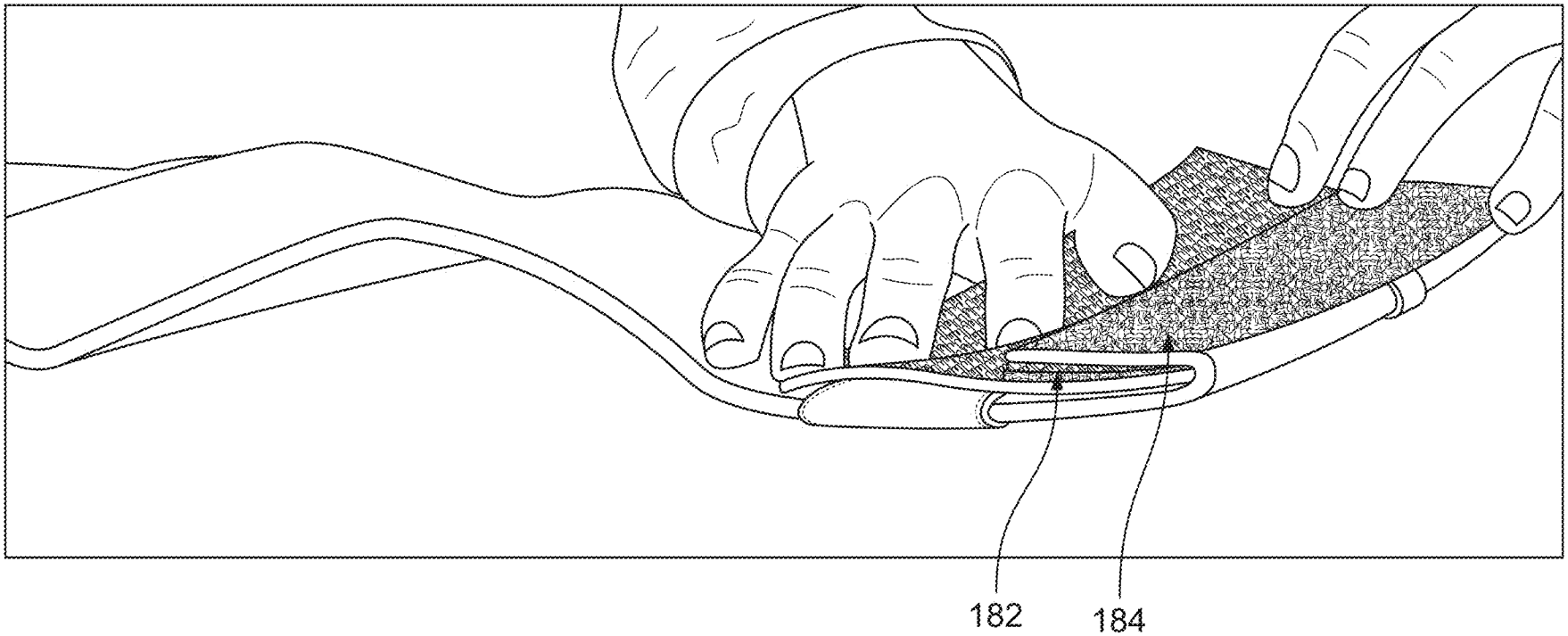
FIG. 8 is a perspective view of a third closure system of the exercise bag system shown in FIG. 1.
Figure 9:
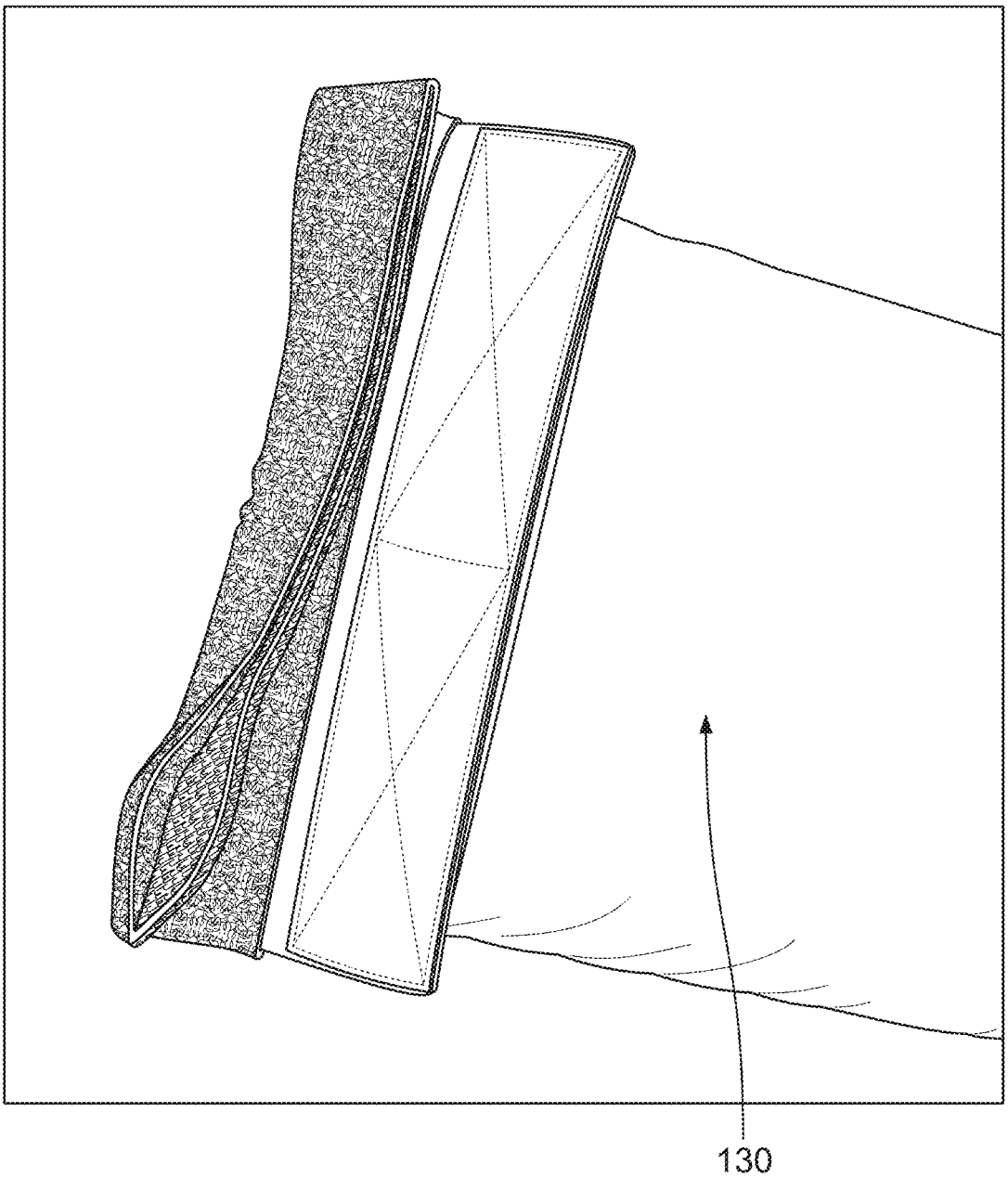
FIG. 9 is a front perspective view of the exercise bag system shown in FIG. 1.
Figure 10:
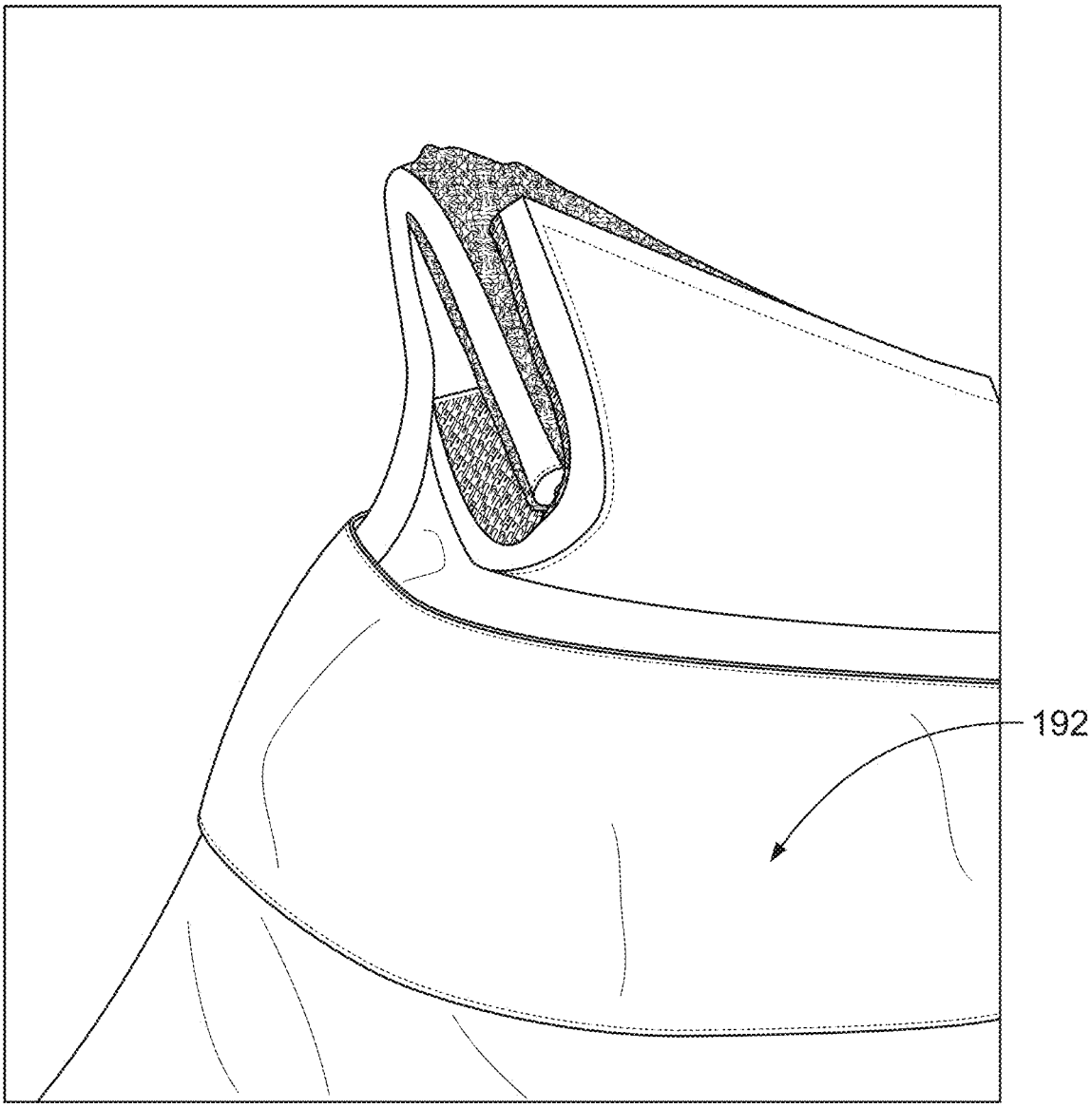
FIG. 10 is a perspective view of the exercise bag system shown in FIG. 1.

In accordance with another embodiment of the present disclosure shown in FIG. 3, the bag article 100 optionally includes an upper handle 196 extending across the upper webbing 192 adjacent the top 120. The bag article 100 optionally includes a lower handle 198 extending across the lower webbing 194 adjacent the bottom 110. The upper and lower handles 196, 198 can be used to facilitate grabbing the bag article 100 during exercise routines. Though not shown, it is to be understood that the bag article 100 may include additional handles or gripping members extending across the bottom 110, top 120, the first side panel 130 and the second side panel 140. In accordance with an aspect, the handles 196, 198 are reinforced, neoprene padded handles. Alternatively, the bag article 100 may not include a handle.

Figure 2:
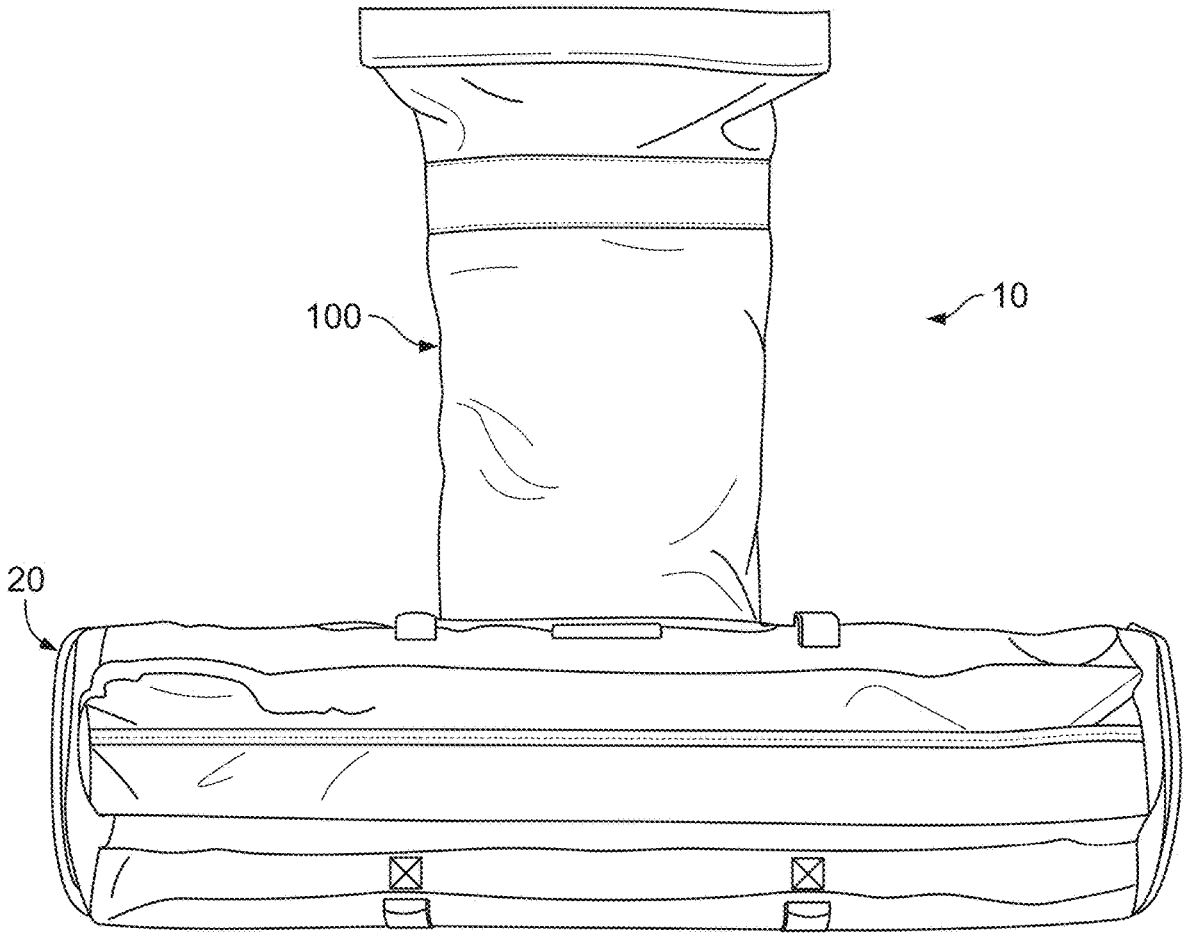
FIG. 2 is a front view of the exercise bag system shown in FIG. 1 with an outer bag.

Referring now to FIG. 2, there is shown an outer bag 20 that is configured to hold the bag article 100 therein. It is to be understood that the dimensions of the outer bag 20 will be complementary or similar to the bag article 100 such that the bag article 100 may be enclosed within the outer bag 20. Similar to the bag article 100, it is to be understood that the outer bag 20 may include a plurality of handles and made from the same materials to facilitate durability and even distribution of weight during use by a user.

The contents of the internal space 150 are not limited to sand 30. For example, a plurality of other weighted materials may also be placed within the internal space 150 to facilitate an exercise regimen tailored to the specific needs of the user or wearer of the bag article 100.

The bag article 100, which may be referred to as a sandbag, is the most streamlined and efficient way to add weight to user workouts and training routines. The bag article 100 includes more padding, stronger seams and additional closure elements to ensure that the bag article can sustain a prolonged period of use before replacement is needed and to ensure that weighted materials are secured within the bag article during use. Each bag article 100 has improved stitching and seams designed to better disperse heavy loads during use while also reducing wear and tear so that the bag article may be used for a longer period of time.

Each of the components of the bag article 100 are made of durable woven fabrics that may include nylon continuous filament yarns. In one example, the woven fabrics of the bag article are formed from 1000D CORDURA® yarns. Certain components may be formed of woven fabrics made with high tenacity continuous filament yarn. For example, the yarns may be 210D HT (High Tenacity) CORDURA® yarns.

Wherever possible, the same or like reference numbers are used throughout the drawings to refer to the same or like features. It should be noted that the drawings are in simplified schematic form and are not drawn to precise scale. Certain terminology is used in the description is for convenience only and is not limiting. Directional terms such as top, bottom, left, right, above, below and diagonal, are used with respect to the accompanying drawings. The words "inwardly" and "outwardly" refer to directions toward and away from, respectively, the geometric center of the identified element and designated parts thereof. Such directional terms used in conjunction with the following description of the drawings should not be construed to limit the scope of the present disclosure in any manner not explicitly set forth. Additionally, the term "a," as used in the specification, means "at least one." The terminology includes the words above specifically mentioned, derivatives thereof, and words of similar import.

"Substantially" as used herein shall mean considerable in extent, largely but not wholly that which is specified, or an appropriate variation therefrom as is acceptable within the field of art. "Exemplary" as used herein shall mean serving as an example.

"About" as used herein when referring to a measurable value such as an amount, a temporal duration, and the like, is meant to encompass variations of ±20%, ±10%, ±5%, ±1%, or ±0.1% from the specified value, as such variations are appropriate.

Throughout this disclosure, various embodiments of the present invention can be presented in a range format. It should be understood that the description in range format is merely for convenience and brevity and should not be construed as an inflexible limitation on the scope of the present invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of exemplary embodiments may be combined in any suitable manner in one or more embodiments. One skilled in the art will recognize, in light of the description herein, that the exemplary embodiments can be practiced without one or more of the specific features or advantages of a particular embodiment. In other instances, additional features and advantages may be recognized in certain embodiments that may not be present in all embodiments of the present disclosure.

While the disclosure is described herein, using a limited number of embodiments, these specific embodiments are not intended to limit the scope of the disclosure as otherwise described and claimed herein. The precise arrangement of various elements and order of the steps of articles and methods described herein are not to be considered limiting. As such, the method can be implemented in any order as desired.

The invention claimed is:

1. An exercise bag system for carrying a mass of sand or other granular particles, comprising:

a bag article having a bottom, a top spaced from the bottom, an opening at the top, and at least first and second side panels that extend from the bottom to the top and defines an internal space such that the opening provides access to the internal space, wherein each of the first and second side panels have an inner surface that at least partially defines the internal space, and outer surface;

a first closure system at the top and proximate the opening and inside the bag article, the first closure system having a first closure element on the inner surface of the first side panel and a second closure element on the inner surface of the second side panel opposite the first closure element, wherein the first closure element and the second closure element are configured to be removably attached to each other;

a second closure system at the top and located entirely on the outer surface of the first side panel, the second closure system having a first closure element at the top on the outer surface and opposite the first closure element of the first closure system on the inner surface, and a second closure element on the outer surface that is adjacent to the first closure element on the outer surface, such that the first closure element and the second closure element of the second closure system are configured to fold toward each other and be removably attached to each other; and a third closure system at the top, the third closure system having a second closure element on the outer surface of the second side panel opposite the second closure element of the first closure system, and a first closure element located on a foldable panel coupled to the first side panel and adjacent the second closure element of the second closure system, such that, when the first closure system and the second closure system are engaged, the second closure element of the third closure system is configured to be removably attached to the first closure element of the third closure system.

2. The exercise bag system of claim 1, further comprising an upper webbing positioned adjacent the top and extending across a width of the first and second side panels.

3. The exercise bag system of claim 2, further comprising a lower webbing positioned adjacent the bottom and extending across a width of the first and second side panels.

4. The exercise bag system of claim 3, wherein the upper webbing and lower webbing each have a width between about 0.5 inches and 4 inches.

5. The exercise bag system of claim 1, wherein the first closure element is a hook closure and the second closure element is a loop closure, for each of the first, second, and third closure systems.

6. The exercise bag system of claim 1, wherein the bag article includes a handle.

7. The exercise bag system of claim 1, wherein the outer surface of the second side panel includes a plurality of stitch lines extending from the bottom to the top.

8. The exercise bag system of claim 1, wherein a width of the bag article is between about 7 to 10 inches and the length of the bag article is between about 20 to 75 inches, such that the internal space is sized to receive therein sand or other granular particles having a weight of about 20 to 220 lbs.

9. The exercise bag system of claim 1, further comprising an outer bag configured to hold the bag article therein.

10. An exercise bag system for carrying a mass of sand or other granular particles, comprising:

a bag article having a bottom, a top spaced from the bottom, an opening at the top, and at least first and second side panels that extend from the bottom to the top and defines an internal space such that the opening provides access to the internal space, wherein each of the first and second side panels have an inner surface that at least partially defines the internal space, and outer surface;

a first closure system at the top and proximate the opening and inside the bag article, the first closure system having a hook closure on the inner surface of the first side panel and a loop closure on the inner surface of the second side panel opposite the hook closure, wherein the hook and loop closures are configured to be removably attached to each other;

a second closure system at the top and located entirely on the outer surface of the first side panel, the second closure system having a hook closure at the top on the outer surface and opposite the hook closure of the first closure system on the inner surface, and a loop closure on the outer surface that is adjacent to the hook closure on the outer surface, such that the hook and loop closures of the second closure system are configured to fold toward each other and be removably attached to each other; and a third closure system at the top, the third closure system having a loop closure on the outer surface of the second side panel opposite the loop closure of the first closure system, and hook closure located on a foldable panel coupled to the first side panel and adjacent the loop closure of the second closure system, such that, when the first closure system and the second closure system are engaged, the hook closure of the third closure system is configured to be removably attached to the loop closure of the third closure system.

11. The exercise bag system of claim 10, further comprising an outer bag configured to hold the bag article therein.

* * * * *